US006419005B1

(12) United States Patent
Korpela

(10) Patent No.: US 6,419,005 B1
(45) Date of Patent: Jul. 16, 2002

(54) MOLD CASSETTE AND METHOD FOR CONTINUOUSLY CASTING THIN SLABS

(75) Inventor: Thomas J. Korpela, Forest Hill, MD (US)

(73) Assignee: Vöest-Alpine Services and Technologies Corporation, Pittsburgh, PA (US)

( * ) Notice: Subject to any disclaimer, the term of this patent is extended or adjusted under 35 U.S.C. 154(b) by 0 days.

(21) Appl. No.: 09/608,075

(22) Filed: Jun. 29, 2000

(51) Int. Cl.[7] ..... B22D 11/10
(52) U.S. Cl. ..... 164/491; 164/436; 164/435
(58) Field of Search ..... 164/491, 436, 164/452, 154.4, 454, 484, 435, 418

(56) References Cited

U.S. PATENT DOCUMENTS 3,709,286 A 1/1973 Bower, Jr.
3,866,664 A 2/1975 Auman et al.
3,890,187 A 6/1975 Glenn
3,893,502 A 7/1975 Slamar
3,963,588 A 6/1976 Glenn
3,967,673 A 7/1976 Bower, Jr.
4,023,612 A * 5/1977 Jackson ..... 164/82
4,053,347 A 10/1977 Glenn
4,124,058 A 11/1978 Gladwin
4,239,078 A * 12/1980 Tarmann ..... 164/147
4,270,593 A * 6/1981 Bachner ..... 164/82
4,421,570 A * 12/1983 Gravemann ..... 148/11.5 C
4,487,249 A 12/1984 Wrhen
4,532,975 A 8/1985 Ives
4,546,813 A 10/1985 Grove et al.
4,612,970 A 9/1986 Grothe
4,615,375 A 10/1986 Bower et al.
4,635,702 A 1/1987 Kolakowski et al.
4,651,802 A 3/1987 Wrhen
4,660,617 A 4/1987 Tsutsumi et al.
4,669,526 A 6/1987 Hury
4,679,614 A 7/1987 Grove
4,702,299 A 10/1987 Gravemann
4,716,955 A 1/1988 Fastert
4,721,151 A * 1/1988 Streubel ..... 164/418
4,727,926 A * 3/1988 Tsutsumi et al. ..... 164/436
4,762,164 A 8/1988 Grove
4,774,995 A 10/1988 Fastert (List continued on next page.)

*Primary Examiner*—Tom Dunn
*Assistant Examiner*—Len Tran
(74) *Attorney, Agent, or Firm*—Steinberg & Raskin, P.C.; Grant E. Pollack

(57) ABSTRACT

A mold cassette and method for continuously casting thin slabs. The cassette comprises a trough including a pair of vertically disposed, opposed broad walls and a pair of opposed narrow walls. The trough has an entry end for receiving molten material and an exit end for dispensing the material. The narrow walls are generally wider at the entry end than the exit end and are adapted for sealing engagement with the broad walls so as to prevent leakage of the material therebetween. At least one of the narrow walls is oriented at a selected tilt and adjustable at the tilt for changing the width of the slab during casting. Back edges of at least one of the adjustable narrow walls are relieved a region corresponding generally to the transition zone of the trough. This allows positioning of the narrow wall in a generally less than vertical plane during casting while maintaining the broad and narrow walls in sealing engagement with one another. At least one of the narrow walls further comprising a face plate with horizontally disposed, concave portions continuously from about the wider end to the narrower end of the plate, to accommodate deformation of solidified portions of the material without undue stress and cracking. The concave portions are preferably in proximity to the transition region such that the slab perimeter of the shell formed in the meniscus region of the slab edge is less than or equal to that exiting the mold. A multi-directional drive assembly is provided for adjusting the spacing between the narrow walls and for maintaining the tilt of at least one of the narrow walls while retaining the broad and narrow walls in sealing engagement with one another.

21 Claims, 11 Drawing Sheets

U.S. PATENT DOCUMENTS 4,811,779 A * 3/1989 Streubel et al. ..... 164/418
4,955,428 A 9/1990 Schrewe
5,172,749 A 12/1992 Flemming
5,176,197 A * 1/1993 Hamaguchi et al. ..... 164/459
5,188,167 A 2/1993 Perry et al.
5,249,622 A * 10/1993 Dalimonte ..... 164/491
5,279,354 A * 1/1994 Grove ..... 164/491
5,297,612 A * 3/1994 Korpela et al. ..... 164/452
5,460,220 A 10/1995 Coassin
5,467,809 A * 11/1995 Arvedi et al. ..... 164/418
5,467,810 A 11/1995 Grove
5,490,555 A * 2/1996 Korpela ..... 164/454
5,730,207 A 3/1998 Pleschiutschnigg
5,766,378 A 6/1998 Horn
5,850,871 A 12/1998 Sears

* cited by examiner

PERIMETER OF SLAB EDGE
$P_1$
START OF TRANSITION LIQUID CORE
61
60
62
26

PERIMETER OF SLAB EDGE
MIDDLE OF TRANSITION LIQUID CORE
61
60
26

PERIMETER OF SLAB EDGE
$P_2$
END OF TRANSITION LIQUID CORE
61
60
26
$P_1 \geq P_2$
65
65
23
22a
63

MOLD CASSETTE AND METHOD FOR CONTINUOUSLY CASTING THIN SLABS

BACKGROUND OF THE INVENTION

The present invention relates generally to materials processing and more particularly to an apparatus and method for producing high quality, thin cast slabs.

Typically, metals such as steel are formed into slabs or strands suitable for transportation and subsequent use in industrial applications. It has been found, in this connection, that the manner in which the metals are formed determines substantially the quality of the product.

During continuous casting, molten steel, for instance, is initially poured into a mold cassette. The cassette is formed by a pair of vertically disposed, opposed broad walls and a pair of vertical opposed narrow walls, the narrow walls usually being adjustable for changing the width of the slab or strand during casting. Each wall is lined by a face plate covering substantially the inner face of the wall, e.g., a thin copper plate or face plate 25 mm thick or less, mounted such as by bolting to a steel back-up plate, e.g., 75 mm thick, and inserted into a frame of the mold.

After the molten steel contacts the face plates, a solidified skin forms, defining a semi-solidified steel slab. As the slab moves down through the cassette, the solidified skin gradually increases in thickness. Upon exiting the cassette, the slab encounters a series of opposing, wide and narrow face rollers. These rollers carry the slab vertically down through the casting system, gradually placing it in a horizontal orientation for exiting the system.

Casting systems of this general configuration are shown, for example, in U.S. Pat. No. 5,297,612, issued Mar. 29, 1993, and in U.S. Pat. No. 5,490,555, issued on Feb. 13, 1996, the disclosures of which are hereby incorporated by reference in their entireties.

Conventional casting systems typically cast slabs to a thickness generally within the range of 6 to 10 inches (or about 15 cm to about 25 cm). To produce these slabs, the appropriate cassette wall configuration has essentially been a rectangle. Hence, the broad walls of such systems have been equally spaced from one another at any level within the cassette. Characteristically, these systems have also be used to cast relatively thin slabs, reducing slab thickness to about 2 inches, i.e., about 5 cm, or less to bypass roughing stands in a hot-strip mill. Thinner slabs are considered advantageous because less reheating is required, and in some cases no reheating, prior to charging to a hot strip mill. This eliminates the need for reheat furnaces, roughing strands, and intermediate conditioning operations. Not only are capital and production costs lowered, but also production yield is increased.

Another feature of traditional systems is their use of thin casting molds with a funnel-like upper portion for receiving liquid metal. Although useful, their walls are not fully adjustable during casting operations, limiting the range of slab widths that may be cast. Other molds for thin casting utilize straight-sided narrow walls that are adjustable to different slab widths and broad walls that are funnel-shaped in their upper central portion. Although helpful, this configuration limits the spacing to which the narrow walls may be adjusted to the length of a straight side portion at the broad wall outer ends, rather than that of the funnel-shaped central portion. As a result, an assortment of different sized molds (e.g., a large size and a small size) must be maintained in order to produce castings over the broad spectrum of widths required by customers.

In addition, the funnel-shaped design fundamentally causes multidimensional deformation of the slab during solidification. Multidimensional deformation, in turn, leads to surface defects (known as "folds" or "laps") in the final coil product. A defect free or "Exposed Automotive" surface is the industry standard for automotive applications, e.g., side panels, doors and hoods. Unfortunately, "folds" may not be rolled out by further processing, such as by running the slab through a hot strip mill. Hence, where folds are present, it is considered generally impossible to produce a defect free surface.

In addition, operation of funnel molds often requires expendable copper plates. Their complex design requires copper plates generally greater than five (5) inches thick, and several man days of machining to form a funnel area on one side of the plate (a.k.a. the "hot face"). An extensive array of water channels machined into the opposite side of the copper plate (a.k.a. the "cold face") for extracting heat from the copper plate during casting, also require detailed machining to form and maintain. Accordingly, while conventional funnel designs are efficient, their maintenance costs are often extraordinarily high.

Accordingly, a mold cassette is desired that not only improves the quality of relatively thin strands being cast, but is also convenient and economical to operate and maintain.

SUMMARY OF THE INVENTION

According to one aspect of the present invention is a continuous casting mold cassette, which comprises:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls being oriented at a selected tilt and adjustable at the tilt for changing the width of the slab during casting, back edges of at least one of the adjustable narrow walls being relieved in a region corresponding generally to the transition zone of the trough to allow positioning of the narrow wall in a generally less than vertical plane during casting while maintaining the narrow and broad walls in sealing engagement with one another;

at least one of the narrow walls further comprising a face plate with horizontally disposed, concave portions continuously from about the wider end to the narrower end of the plate, to accommodate deformation of solidified portions of the material without undue stress and cracking; and a multi-directional drive assembly for adjusting the spacing between the narrow walls and for maintaining the tilt of at least one of the narrow walls while retaining the broad and narrow walls in sealing engagement with one another.

In accordance with another aspect of the present invention is a cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls being oriented at a selected tilt and adjustable at the tilt for changing the width of the slab during casting, back edges of at least one of the adjustable narrow walls being relieved in a region corresponding generally to the transition zone of the trough to allow positioning of the narrow wall in a generally less than vertical plane during casting while maintaining the narrow and broad walls in sealing engagement with one another;

at least one of the narrow walls comprising a face plate and a back-up plate, the face plate having cooling slots therein, the slots being deeper in the lower section of the narrow face plate than in the upper section;

at least one of the narrow walls further comprising a face plate with horizontally disposed, concave portions continuously from about the wider end to the narrow end of the plate, to accommodate deformation of solidified portions of the material without undue stress and cracking; and a multi-directional drive assembly for adjusting the spacing between the narrow walls and for maintaining the tilt of at least one of the narrow walls while retaining the broad and narrow walls in sealing engagement with one another.

According to a further aspect of the present invention is a cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls being oriented at a selected tilt and adjustable at the tilt for changing the width of the slab during casting, back edges of at least one of the adjustable narrow walls being relieved in a region corresponding generally to the transition zone of the trough to allow positioning of the narrow wall in a generally less than vertical plane during casting while maintaining the narrow and broad walls in sealing engagement with one another;

at least one of the narrow walls comprising a face plate and a back-up plate, the back-up plate having cooling slots therein, the slots being deeper in the lower section of the narrow back-up plate than in the upper section;

at least one of the narrow walls further comprising a face plate with horizontally disposed, concave portions continuously from about the wider end to the narrower end of the plate, to accommodate deformation of solidified portions of the material without undue stress and cracking; and a multi-directional drive assembly for adjusting the spacing between the narrow walls and for maintaining the tilt of at least one of the narrow walls while retaining the broad and narrow walls in sealing engagement with one another.

According to yet another aspect of the present invention is a method of continuously casting relatively thin slabs, which comprises the steps of:

pouring molten material into a trough, the trough including a pair of vertically disposed, opposed broad walls and a pair of opposed narrow walls, the trough further having an entry end for receiving molten material and an exit end for dispensing the material, the narrow walls being generally wider at the entry end than the exit end and being adapted for sealing engagement with the broad walls so as to prevent leakage of the material therebetween;

adjusting during casting at least one of the narrow walls to a selected slab width, back edges of at least one of the adjustable narrow walls being relieved in proximity to the transition zone of the trough for positioning the narrow wall in a generally less than vertical plane during casting while maintaining the broad and narrow walls in sealing engagement with one another;

adjusting the spacing between the narrow walls while retaining the broad and narrow walls in sealing engagement with one another; and dispensing at least a semi-solidified slab of the material from the exit end of the trough.

According to still a further aspect of the present invention is a method of continuously casting relatively thin slabs, which comprises the steps of:

pouring molten material into a trough, the trough including a pair of vertically disposed, opposed broad walls and a pair of opposed narrow walls, the trough further having an entry end for receiving molten material and an exit end for dispensing the material, the narrow walls being generally wider at the entry end than the exit end and being adapted for sealing engagement with the broad walls so as to prevent leakage of the material therebetween;

adjusting during casting at least one of the narrow walls to a selected slab width, back edges of at least one of the adjustable narrow walls being relieved in proximity to the transition zone of the trough for positioning the narrow wall in a generally less than vertical plane during casting while maintaining the broad and narrow walls in sealing engagement with one another, at least one of the narrow walls comprising a face plate with horizontally disposed, concave portions continuously from about the wider end to the narrower end of the plate, to accommodate deformation of solidified portions of the material without undue stress and cracking;

adjusting the spacing between the narrow walls while retaining the broad and narrow walls in sealing engagement with one another; and dispensing at least a semi-solidified slab of the material from the exit end of the trough.

According to yet another aspect of the present invention is a cassette for a continuous casting mold. The cassette comprises a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls being oriented at a selected tilt and adjustable at the tilt for changing the width of the slab during casting, back edges of at least one of the adjustable narrow walls being relieved in a region corresponding generally to the transition zone of the trough to allow positioning of the narrow wall in a generally less than vertical plane during casting while maintaining the narrow and broad walls in sealing engagement with one another;

at least one of the narrow walls further comprising a face plate with horizontally disposed, concave portions continuously from about the wider end to the narrow end of the plate, to accommodate deformation of solidified portions of the material without undue stress and cracking, the face plate comprising a beryllium-copper alloy; and a multi-directional drive assembly for adjusting the spacing between the narrow walls and for maintaining the tilt of at least one of the narrow walls while retaining the broad and narrow walls in sealing engagement with one another.

In accordance with still a further aspect of the present invention is a cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls having back edges that are relieved in a region corresponding generally to the transition zone of the trough to allow positioning of the narrow wall in a generally less than vertical plane during casting while maintaining the narrow and broad walls in sealing engagement with one another;

at least one of the narrow walls further comprising a face plate with horizontally disposed, concave portions continuously from about the wider end to the narrower end of the plate, to accommodate deformation of solidified portions of the material without undue stress and cracking, the face plate comprising a beryllium-copper alloy; and a multi-directional drive assembly for adjusting the spacing between the narrow walls and for maintaining the tilt of at least one of the narrow walls while retaining the broad and narrow walls in sealing engagement with one another.

According to another aspect of the present invention is a narrow wall for a cassette of a continuous casting mold, wherein the wall has a beryllium-copper face plate with continuous, horizontally disposed, concave portions for accommodating deformation of solidified portions of the material being cast without undue stress and cracking, and edges relieved in a region corresponding generally to the transition zone of the mold for positioning of the narrow wall in a generally less than vertical plane while maintaining the narrow wall in sealing engagement with adjacent walls of the cassette.

Accordingly, it is an object of the present invention to provide an improved continuous casting mold cassette for casting relatively thin strands.

Another object of the present invention is to provide for simple and efficient continuous casting operations.

A further object of the present invention is to provide high quality continuously cast products at a lower cost.

Yet another object of the present invention is to provide a mold cassette for casting relatively thin strands which is convenient and economical to operate and maintain.

Still another object of the present invention is to provide an improved mold cassette for casting relatively thin strands with a unique broad and narrow face plate material and design combination.

Yet a further object of the present invention is to provide a mold cassette which increases production yield upon continuous casting operations.

Another object of the present invention is to provide a novel face plate configuration for accommodating deformation of solidified portions of a material being cast without undue stress or cracking.

Still a further object of the present invention is to provide a unique face plate configuration and material which allows shell deformation without undue stress and cracking.

Yet another object of the present invention is to provide for adjustment of the spacing between and orientation of the walls of a mold, while retaining the walls in sealing engagement with one another.

The present invention will now be further described by reference to the following drawings which are not intended to limit the scope of the accompanying claims.

BRIEF DESCRIPTION OF THE DRAWINGS

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
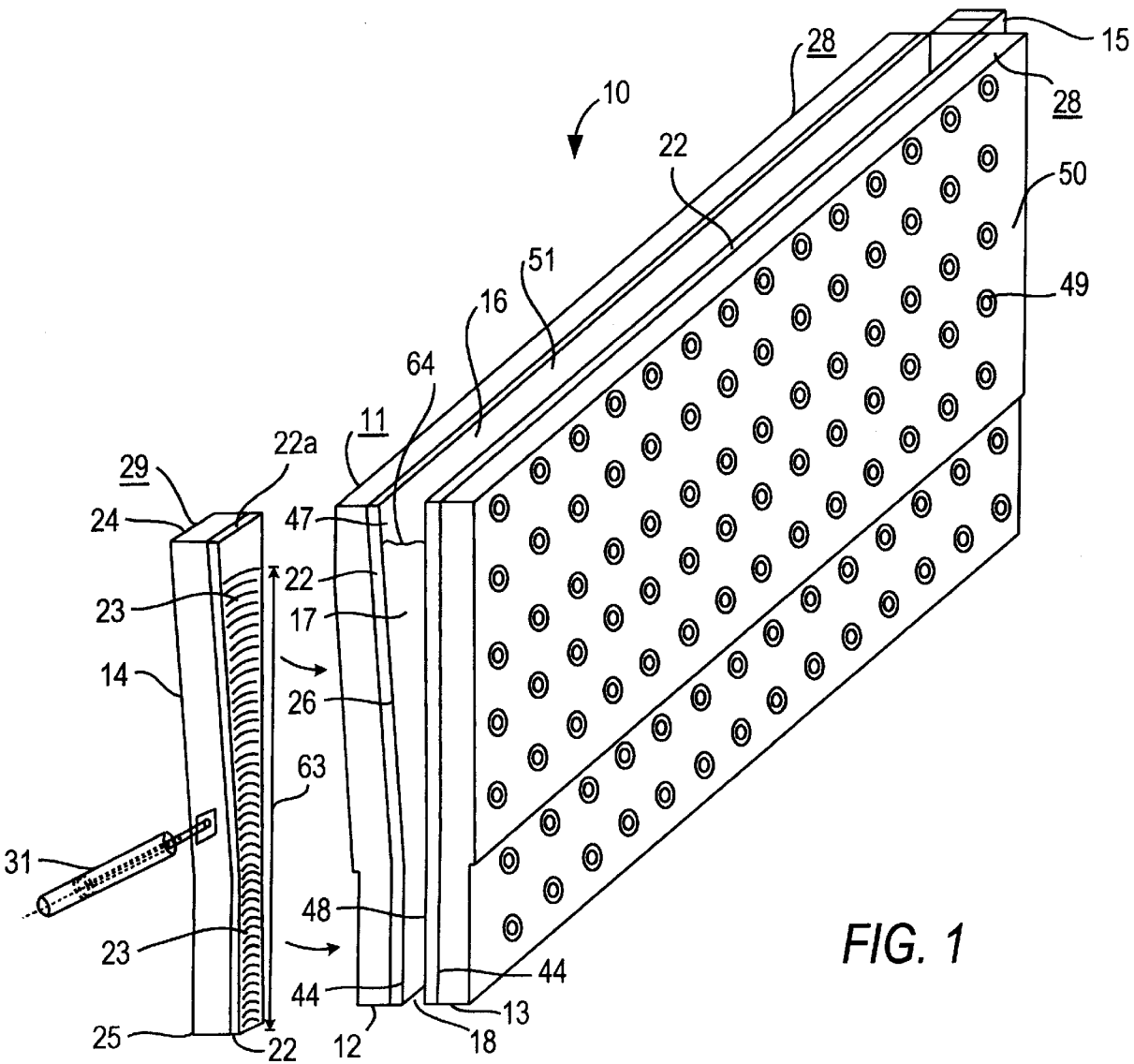
FIG. 1 is a perspective view of a mold cassette, according to one aspect of the present invention.

Referring now to the drawings and, more particularly, to FIGS. 1–15A, there is shown generally a continuous casting mold cassette 10 in accordance with various aspects of the present invention. According to one embodiment, as illustrated in FIG. 1, the cassette comprises a trough 11 defined by a pair of vertically disposed, opposed broad walls 12, 13 and a pair of opposed narrow walls 14, 15. The cassette has an upper portion or entry end 16 adapted for receiving a fluidic material 17, e.g., molten steel, and a lower portion or exit end 18 for dispensing the material. The narrow walls are adapted for sealing engagement with the broad walls so as to prevent leakage of the material therebetween.

Figures 2, 3:
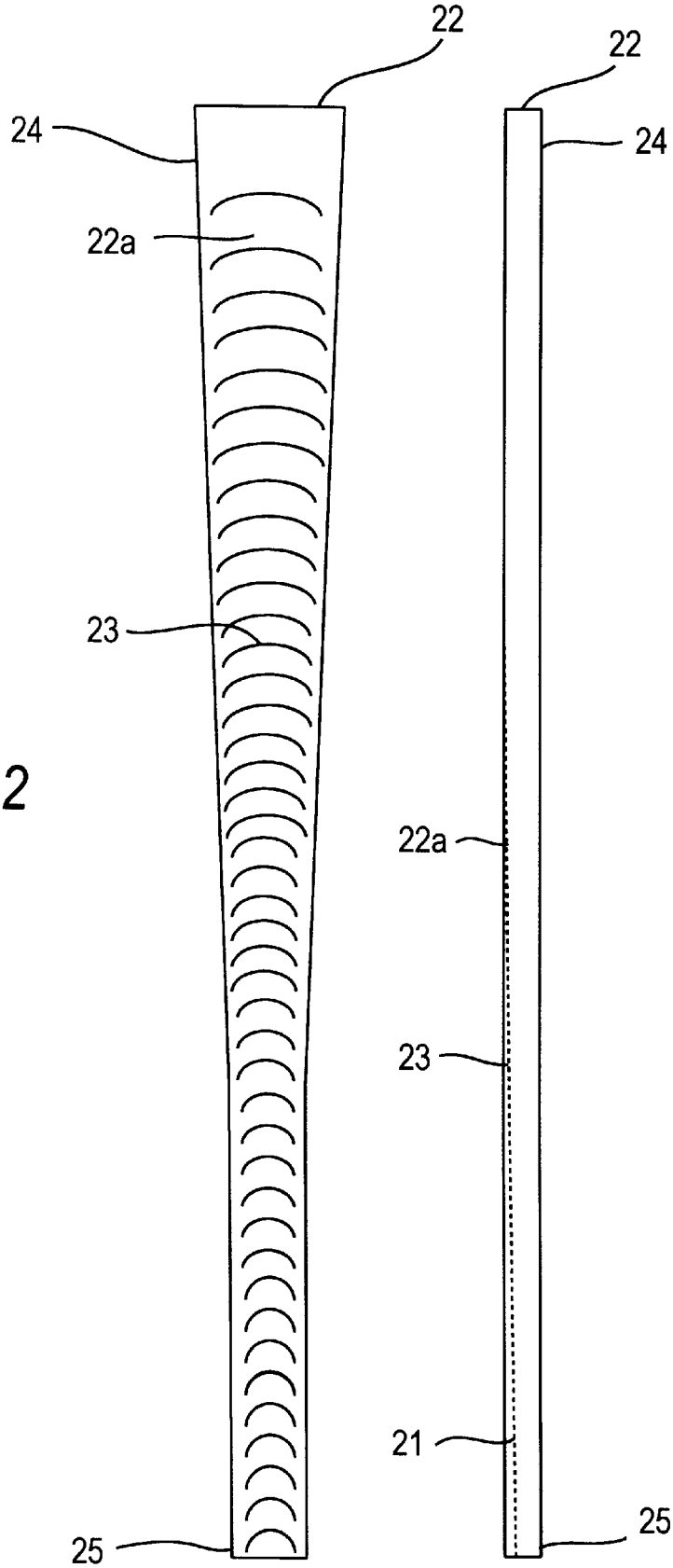
FIG. 2 is a plan view of the narrow face plate of FIG. 1 showing concave portions on the face thereof.
FIG. 3 is a side view of the narrow face plate of FIG. 2.
Figure 4:
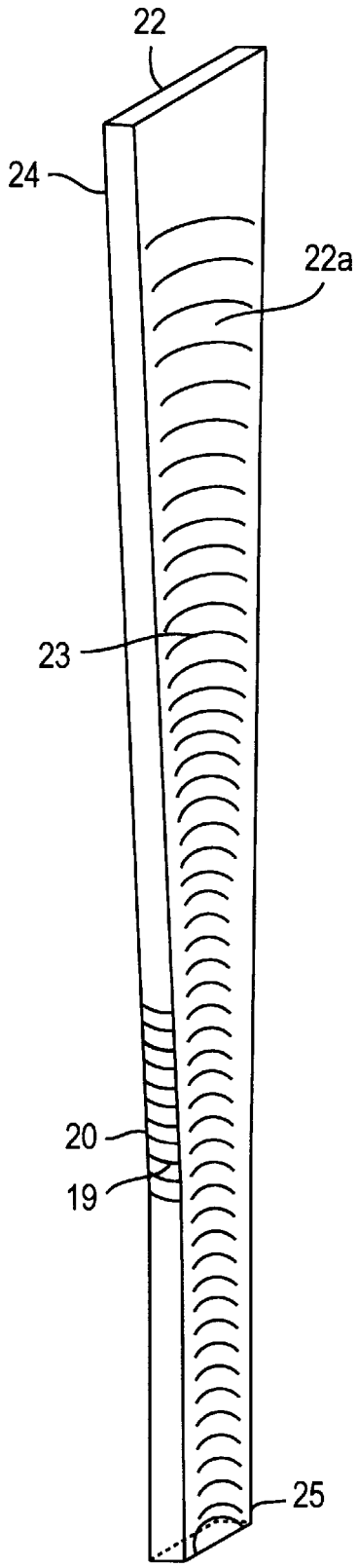
FIG. 4 is a perspective view of the narrow face plate of FIG. 2 showing relieved portions along a selected face plate edge.

As best seen in FIGS. 1, 2 and 4, narrow walls 14, 15 are generally wider at the entry end than the exit end, the width of the upper portion being preferably no more than about twice that of the lower portion. A mold of this general configuration is set forth in U.S. Pat. No. 5,279,354, entitled "Method of Continuous Casting with Changing of Slab Width", issued to John W. Grove on Jan. 18, 1994, the disclosure of which is hereby incorporated by reference herein in its entirety. According to one aspect of the present invention, the width of the lower portion is within a range of about 50 mm and about 60 mm.

At least one of the narrow walls is oriented at a selected taper or tilt 21 and adjustable to allow change in the width of the slab during casting. As shown in FIG. 4, back edges 19 along a selected length 20 of at least one of the adjustable narrow walls are relieved in proximity to a transition zone 63 of the trough. The transition zone is that region where the slab edge transforms from a tapered configuration to a substantially straightened form. By relieving the narrow wall back edges along the transition zone, the wall may be readily positioned in a generally less than vertical plane, i.e., taper or tilt, during casting while maintaining the broad and narrow walls in sealing engagement with one another.

Generally speaking, the angle of tilt of the narrow wall(s) is a function of slab width and must be adjustable so as to maintain the desired sealing engagement between the broad and narrow walls. In one embodiment of the present invention, the tilt of each narrow wall is about 0.5% of the total width of the slab being cast. As best seen in FIG. 3, this tilt or taper is preferably continuous from the top of the wall to the bottom for optimal operation.

Also, the narrow walls desirably each mount a narrow face plate 22, e.g., comprising a beryllium-copper alloy, with horizontally disposed, concave portions 23 continuously from about wider end 24 to narrow end 25 of the plate. This plate configuration accommodates deformation of the slab shell 26 without undue stress or cracking of the molten material 17 being cast.

As shown in FIGS. 6–8A, a stud bolt and fastener arrangement 59 is used to join each narrow face plate to its corresponding narrow back-up plate 35. From the wider end of the face plate to the narrower end, the bolts and fasteners, e.g., 55, 56, steadily decrease in diameter generally in proportion to the corresponding face plate width so as to maintain structural integrity.

With these uniquely shaped narrow face plates 22 (which, in turn, define the novel configuration of the cassette) and relieved back edges 20 at the transition zone, the present invention advantageously permits movement of the narrow face plate to a position somewhat less than vertical during casting, while still maintaining the broad and narrow face plates in sealing engagement with one another. By maintaining this sealing engagement, the novel combination of the present invention, in turn, prevents leakage of molten metal, resulting in a defect free slab surface with crack free edges. In this connection, the narrow face plate taper or tilt is believed essential to sustained cassette performance during casting operations. Without it, the caster can not operate.

Referring now to the broad walls of the cassette, as shown in FIG. 1, inner surfaces 44, in proximity to the exit end of the cassette, extend substantially parallel to the direction of casting. By providing sealing engagement in cassette upper portion 45 between broad wall inner surfaces 44 and corresponding inner surfaces 46 of the narrow walls, a cavity 47 is formed in the upper portion of the trough for receiving molten metal.

Optimally, the cassette is a separate and distinct unit, that may be inserted into a frame assembly 27 to form a casting mold 1. It preferably comprises two (2) broad face assemblies 28 and two (2) narrow face assemblies 29. The broad face assembly includes a copper face plate 48 bolted such as by stud bolts 49 to a steel back-up plate 50. The stud bolts are not only arranged in a unique pattern, but also sized to match the bolting torque requirements necessary for maintaining the desired seal between the steel back-up plate and copper face plate. A stud bolt configuration, in accordance with the present invention, is illustrated generally in FIG. 1.

Since entry end 16 of the cassette has an opening 51 sized not more than twice the width of lower portion or exit end 18, the resulting trough configuration provides unique spacing between the broad face plates. Moreover, because deformation during solidification is typically a one dimensional phenomena, this configuration also allows for crack free deformation during the solidification at the wide or broad face of the slab, facilitating production of a defect free surface.

Figure 5:
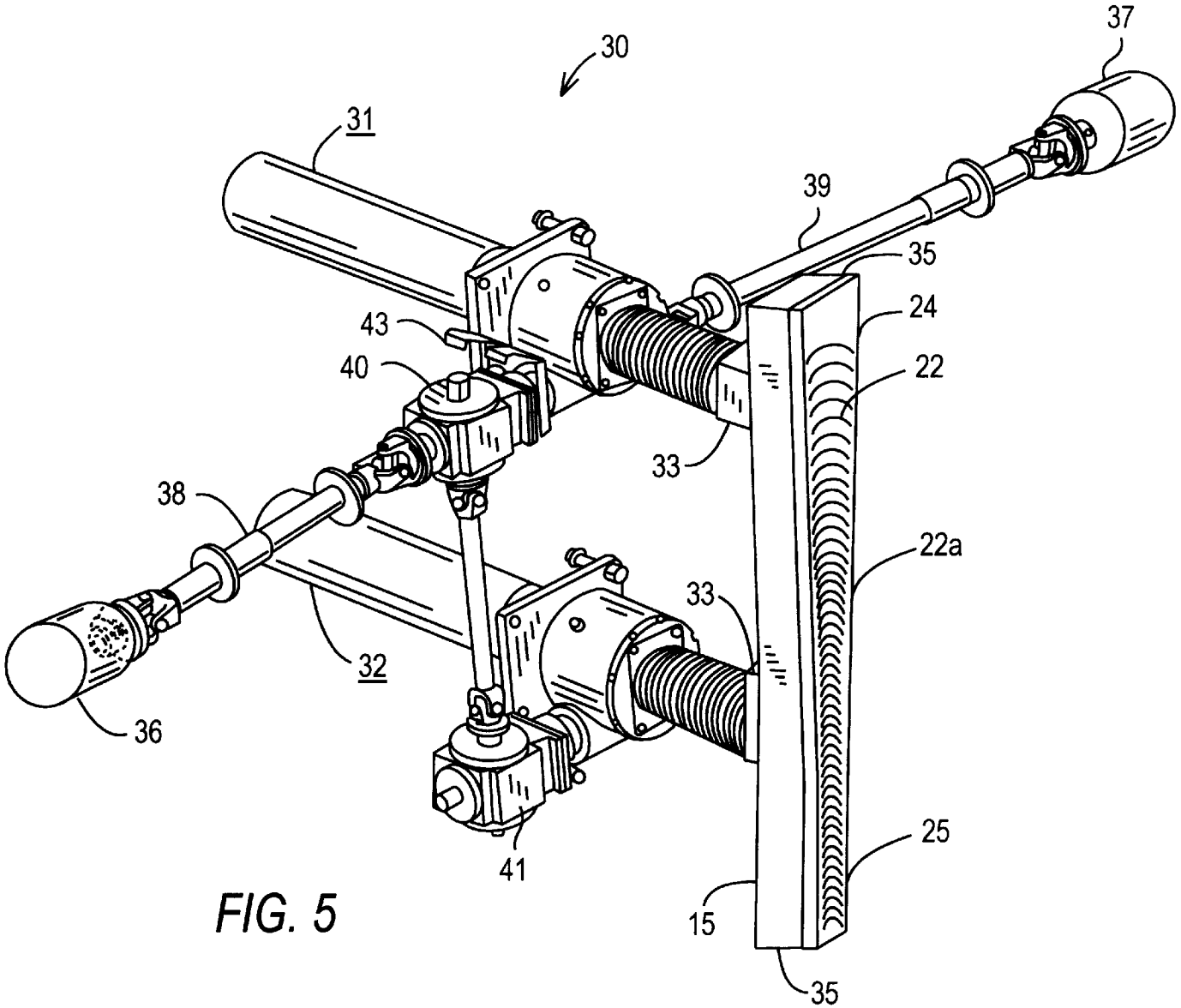
FIG. 5 is an isometric view of a multi-directional drive assembly in accordance with one aspect of the present invention.
Figure 6:
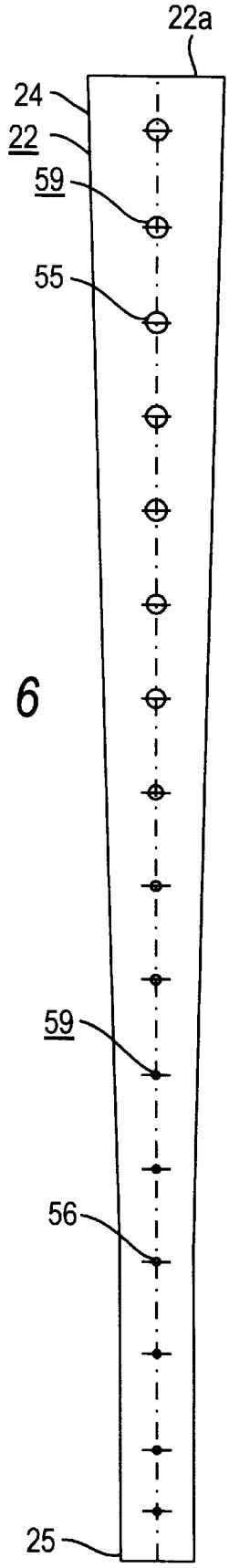
FIG. 6 is a rear view of the narrow face plate of FIG. 2 showing stud bolts and fasteners for joining the face plate to the back-up plate.
Figure 7:
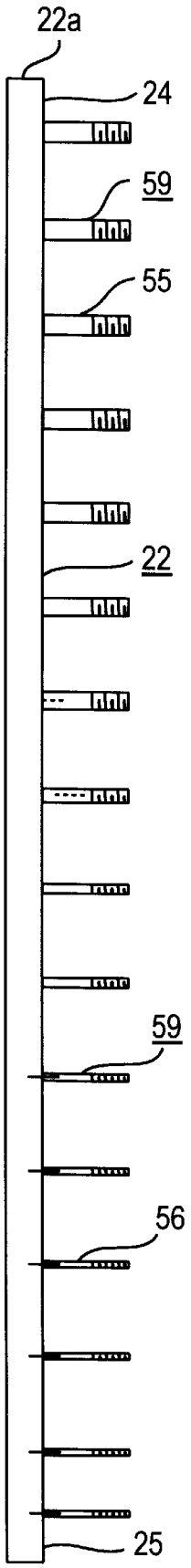
FIG. 7 is a side view of the face plate of FIG. 6.
Figure 8:
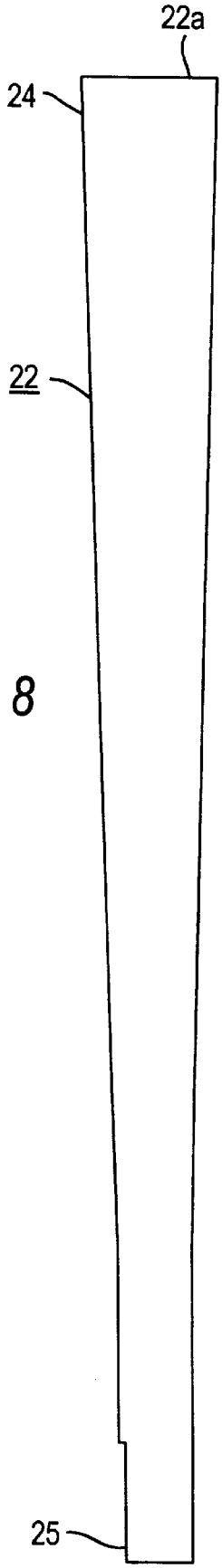
FIG. 8 is a front view of the narrow face plate of FIG. 2.
Figure 8A:
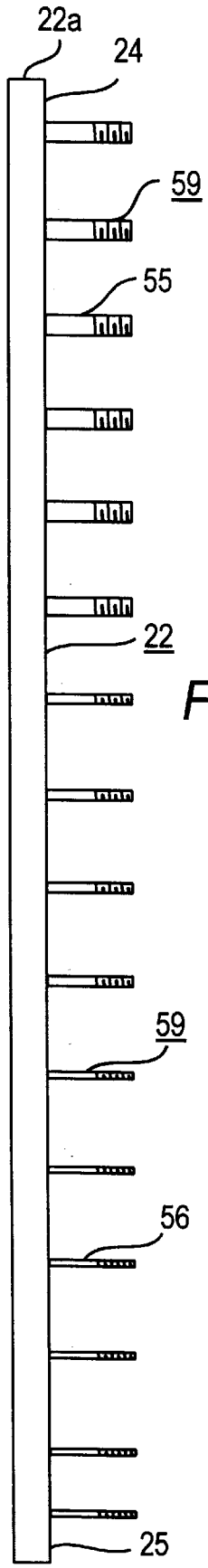
FIG. 8A is a side view of the face plate of FIG. 8.

As best seen in FIG. 5, a multi-directional drive assembly 30 is provided for adjusting the spacing between the narrow walls and for maintaining the tilt of at least one of the narrow walls while retaining the broad and narrow walls in sealing engagement with one another. Conventional drive mechanisms are considered suitable for this application including, but not limited to, ball screws such as ACME nut and screws, telescoping boom mechanisms, and stepping hydraulic cylinders.

According to one aspect of the present invention, the assembly is oriented vertically, having upper and lower drive screw assemblies 31, 32, respectively, for translational movement of the narrow walls toward and away from the slab. To insure uniformity of wall movement, upper screw assembly 31 is desirably located in proximity to wide end 24 of the narrow wall, whereas the lower screw assembly is positioned near the narrow end. Between the operative ends 33 of each screw assembly and their respective face plates 22 is an extended back up plate 35, e.g., constructed of steel or the like, and a copper face plate 22*a*, preferably constructed in whole or in part of a beryllium-copper alloy. An alloy of this general description is set forth in U.S. Pat. No. 5,651,844, which issued on Jul. 29, 1997, the disclosure of which is hereby incorporated by reference in its entirety.

Each screw assembly 31, 32 is, in addition, equipped with its own driver motor 36, 37, respectively, operatively connected to the assembly by a corresponding spindle 38, 39 and gear box 40, 41 arrangement. A clutch assembly 43 is also operatively connected to and between both assemblies. Overall, drive assembly 30 controls not only the rate of wall movement, but also maintains uniformity of their movement and location. Other drive assembly components and functional details are considered known by those skilled in the art and further explanation is believed unnecessary for illustration of the present invention.

Turning now to the slab cooling features of the present invention, as shown in FIGS. 9–13, cooling slot and hole arrangements are utilized according to various aspects of the present invention. Typically, to efficiently extract the heat of molten steel through the copper face plate and, thereby, form a uniform, solidified shell or skin 26, the speed of water through slots 52, i.e., the narrow and broad face assembly, must be maintained generally within a range of 8 and 10 meters/second. Flow velocities above this range, though effective for cooling, have been found difficult and expensive to maintain. If the flow rate falls below 8–10 meters/second, the water may turn to steam, resulting in uneven cooling of the slabs such as hot spots. Hot spots ultimately result in poor solidification of the thin shell and may erupt into a mold "breakout". A breakout can interrupt casting operations for many hours or even days, causing extensive equipment damage and loss of production.

Figure 9:
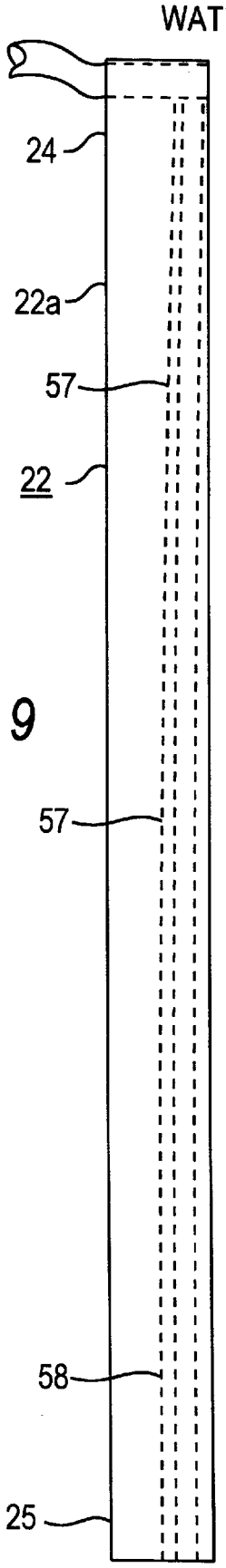
FIG. 9 is a side view of the narrow side wall shown in FIG. 2 illustrating the location of drilled holes in the back-up plates, according to one aspect of the present invention.
Figure 9A:
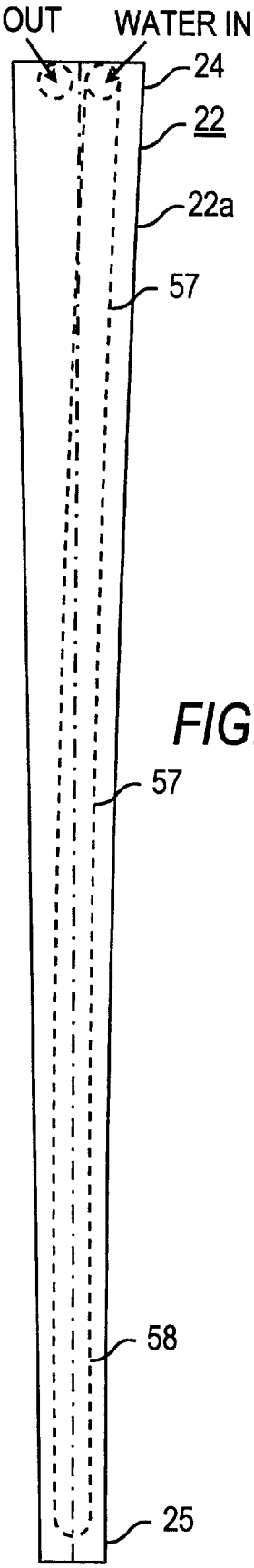
FIG. 9A is a front view of the narrow side wall of FIG. 9.

Generally speaking, cooling slots 52 are located in the cooper face plates 22*a* (see FIGS. 10–12), and cooling holes 57, 58 in the steel back-up plates 50 (shown in FIGS. 9 and 9A), alternatively or concurrently, within the spirit and scope of the present invention. As illustrated in FIGS. 9 and 9A, holes 57, 58 are preferably gun drilled for providing water to the copper face plate.

Figure 10:
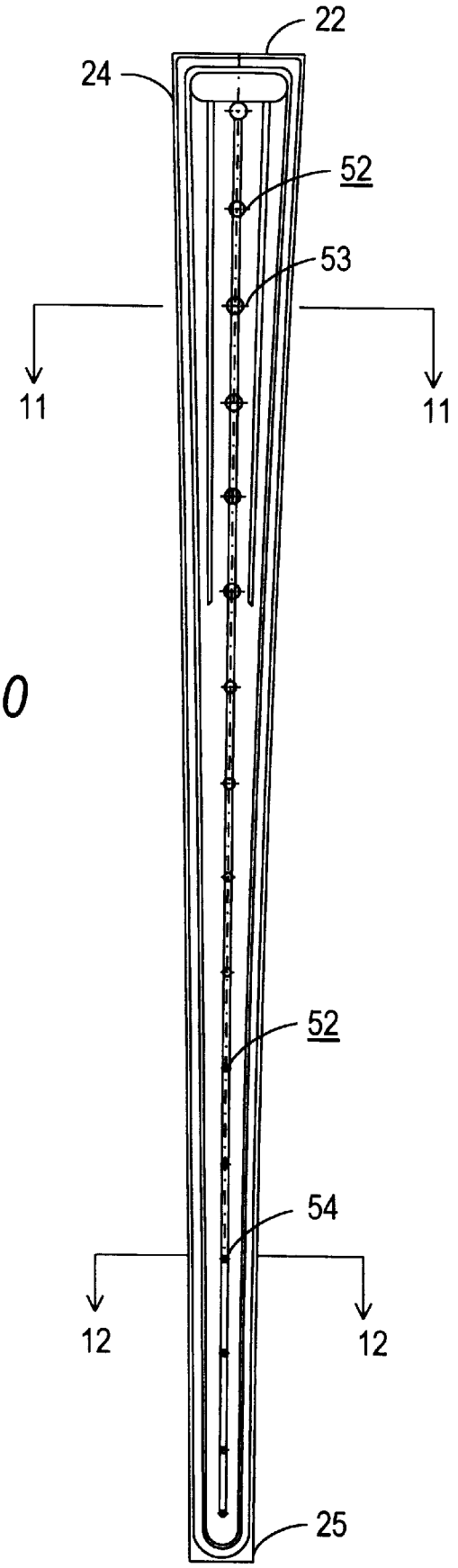
FIG. 10 is a plan view of the back-up plate of FIG. 9 showing water slots, according to the present invention.
Figure 11:
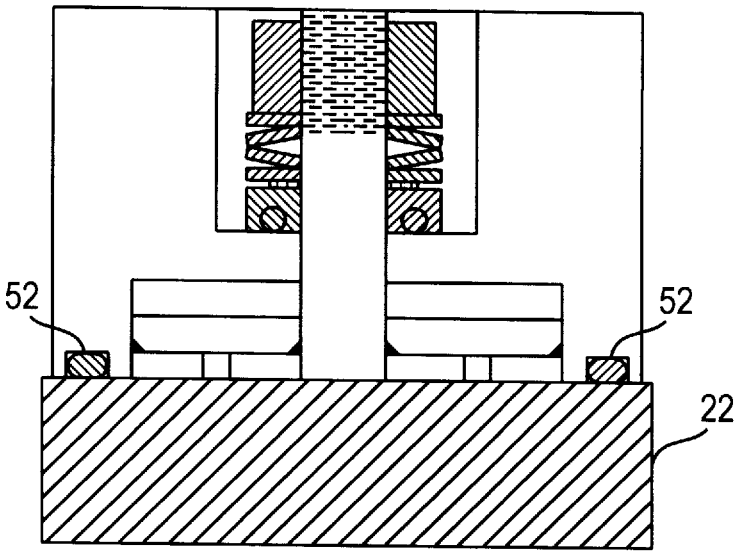
FIG. 11 is a sectional view of the narrow face plate taken along line 11—11 of FIG. 10.
Figure 12:
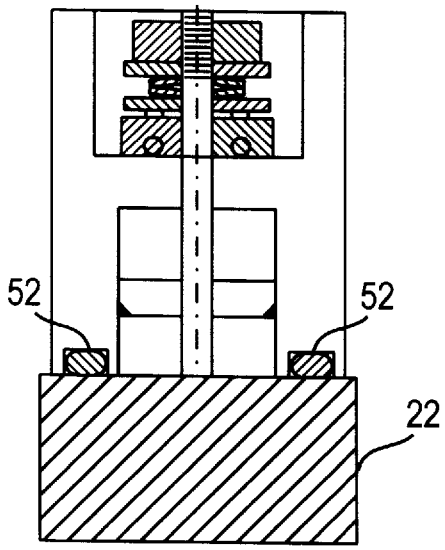
FIG. 12 is a sectional view of the narrow face plate taken along line 12—12 of FIG. 10.
Figure 13:
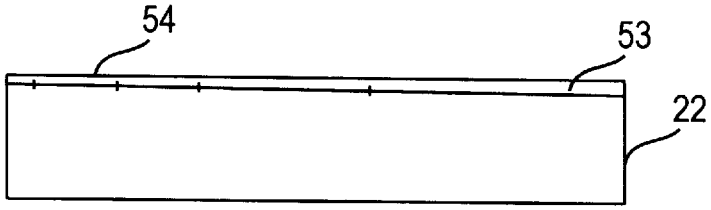
FIG. 13 is a diagram showing the depth of the cooling slots as a function of mold depth.

The speed of the cooling water is desirably controlled by varying the depth of the cooling slots, as best seen in FIGS. 10–12. Specifically, it is preferred that deeper slots 53 be used in the lower section of the narrow face assembly due to its relatively smaller cross sectional area. In the upper section, on the other hand, shallow slots 54 are desired due to the generally larger cross section of the assembly there. This arrangement, in combination with other novel aspects of the present invention, such as the unique shape of the narrow face copper plate, also aids in the production of a uniform, solidified shell.

The cooling slots of the narrow walls are so designed to maintain a constant cross sectional area throughout the cooling process. Since the cross section of the lower portion is less than that of the upper portion, the depths of the cooling slots vary gradually throughout the trough assembly. This helps to maintain the desired water velocity, i.e., generally within a range of 8 and 10 meters/second.

Figures 14, 14A, 14B, 14C:
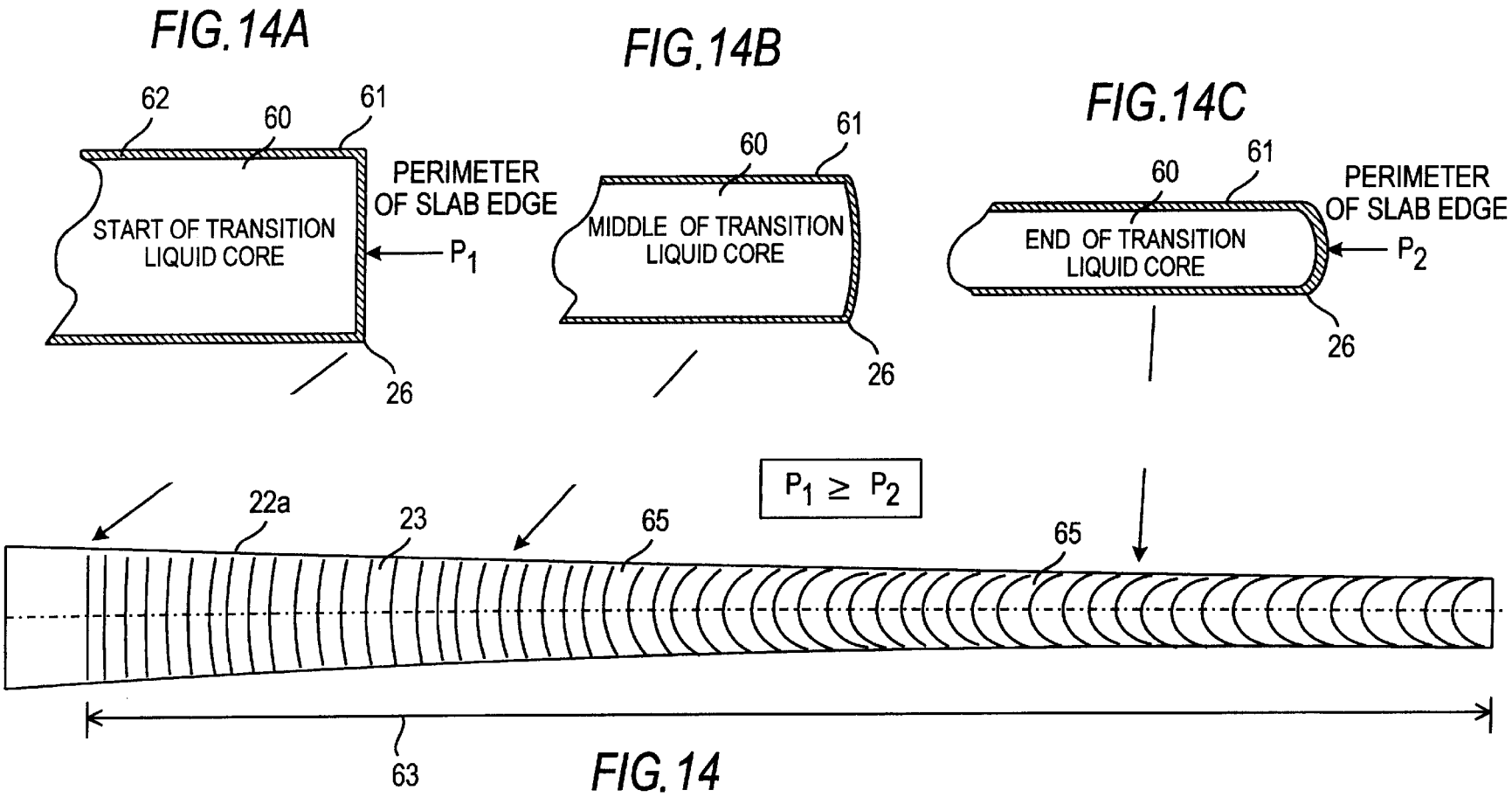
FIG. 14 is a plan view of the narrow face plate of FIG. 1 illustrating a transition zone, according to one aspect of the present invention.
FIG. 14A is a diagram showing slab formation, in accordance with FIG. 14, at the beginning of the transition zone.
FIG. 14B is a diagram showing slab formation, in accordance with FIG. 14, at the middle of the transition zone.
FIG. 14C is a diagram showing slab formation, in accordance with FIG. 14, at the end of the transition zone.

A slab 60 cast in accordance with the present invention is illustrated in FIGS. 14A–14C. During slab formation, perimeter movement of the narrow face is both downward and outward, away from the cavity. To produce a defect free surface, the volume of metal generated or "displaced" during casting, upon reduction of slab edge 61, must be transferred to the center of the end sections. Again, the unique concave contour on the narrow face, according to various aspects of the present invention, allows such shell formation without undue stress and cracking.

Movement of the slab perimeter may be accomplished in at least two ways. First, as shown in FIGS. 14 and 14A, upper portion 62 of solidified shell or skin 26 that forms during casting must either be held at a high solidification rate or be in a "mushy" state. Second, transition zone 63 of narrow face copper plate 22*a* must be contoured 23 so as to achieve controlled development of slab deformation at back edges 19, as illustrated in FIGS. 14 and 14B. As a result, the perimeter $P_1$ of the shell formed at the meniscus 64 is equal to or less than the shell perimeter $P_2$ exiting the mold:

$$P_1 < P_2$$

This is best seen in FIGS. 14 and 14C.

It is considered critical that the rate of solidification in the upper section of the narrow face cast slab be reduced. To this end, various features are provided. First, to create the desired amount of shell formation in the upper and transition areas of the cassette, additional material 65 is added to the surface of the narrow face copper plate. Several combinations of material and/or coatings are preferably used such as a nickel-chrome or nickel-iron alloy. Second, the material of the copper plate is selected so as to provide the lowest possible thermal conductivity. Appropriate materials include refractories, commercially pure copper, copper-chrome-zirconium, and beryllium-copper alloys, e.g., Phase 3™, Phase 3HP® or the like. These materials may be applied to the narrow face plate surface or incorporated therein, as illustrated generally in FIG. 14.

Figures 15, 15A:
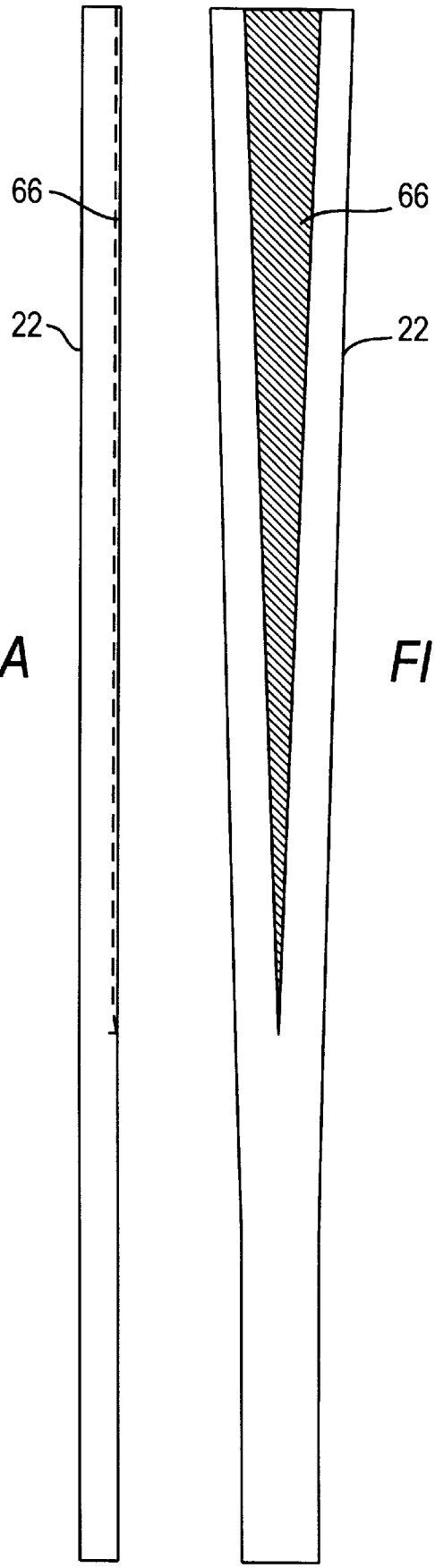
FIG. 15 is a plan view of the narrow face plate of FIG. 1 illustrating a wedge-like region of "zero" or reduced heat conductivity.
FIG. 15A is a side view of the narrow face plate of FIG. 15 showing the depth of the wedge-like region.

In effect, as shown in FIGS. 15 and 15A, the transition zone defines a wedge-like region 66, on the narrow face plates, of "zero" or reduced heat conductivity. This region, in preventing shell formation within, is believed important for the production of a uniform, solidified shell with a defect free surface.

Referring now to another aspect of the present invention, there is provided a method of continuously casting relatively thin slabs. First, molten material such as steel is poured into a trough, the trough including the pair of vertically disposed, opposed broad walls and the pair of opposed narrow walls. The trough, as before, has the entry end for receiving molten material and the exit end for dispensing the material. The narrow walls are generally wider at the entry end than the exit end and are adapted for sealing engagement with the broad walls to prevent leakage of the material therebetween.

Next, during casting operations, at least one of the narrow walls is adjusted to a selected slab width. In accordance with the present invention, back edges of at least one of the adjustable narrow walls are relieved in proximity to the transition zone of the trough. This allows positioning of the narrow wall in a generally less than vertical plane during casting while maintaining the broad and narrow walls in sealing engagement with one another. Finally, a semi-solidified slab of material is dispensed from the exit end of the trough.

Overall, the present invention advantageously provides one dimensional deformation of the solidified skin in the cassette broad face section. This is accomplished, as least in part, by controlling the slab contour in the transition section of the narrow walls such that the shell perimeter in proximity to meniscus 64 (See FIGS. 1 and 14) is less than or equal to that exiting the mold.

In addition, the cassette, according to the present invention, is fully versatile, being adaptable to any conventional or state-of-the-art casting mold system. It is also compatible with conventional control software for casting systems, such as Parallel, Z, and stepping routines, commonly utilized for mold width adjustments.

Furthermore, the broad copper face plates are uniquely shaped and machined to the same contour as the narrow copper face plates. The resulting shape of the cassette insert allows the user to cast over the entire range of product widths using a single mold cassette. Also, the rate of solidification at the narrow wall of the cast slab is controlled, in the upper portion of the cassette insert, by the combination of materials and/or coatings which facilitate formation of the desired shell.

Although the embodiments illustrated herein have been shown and described for use in casting steel or the like, it is understood that an analogous process could be practiced on other metals, giving consideration to the purpose for which the present invention is intended.

The above-described arrangement and methodology is merely illustrative of the principles of the present invention. Numerous modifications and adaptations thereof will be readily apparent to those skilled in the art without departing from the spirit and scope of the present invention. For example, although the present invention has been generally described as being adapted for casting metal products and the like, it is understood that any material (including non-metals) could be cast giving consideration to the purpose for which this invention is intended. In addition, while a trough-like, variable width mold has been described for operation in a vertical orientation, it is also understood that any suitably oriented or shaped mold could be utilized consistent with the principles set forth herein.

What is claimed is:

1. A cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls being oriented at a selected tilt and adjustable at the tilt for changing the width of the slab during casting, back edges of at least one of the adjustable narrow walls having a selected chamfered-like portion in a region corresponding generally to the transition zone of the trough to allow positioning of the narrow wall in a generally less than vertical plane during casting while maintaining the narrow and broad walls in sealing engagement with one another;

at least one of the narrow walls further comprising a face plate with horizontally disposed, concave portions continuously from about the wider end to the narrower end of the plate, the concave portions gradually increasing in depth from about the wider end to the narrower end, to accommodate deformation of solidified portions of the material without undue stress and cracking; and a multi-directional drive assembly for adjusting the spacing between the narrow walls and for maintaining the tilt of at least one of the narrow walls while retaining the broad and narrow walls in sealing engagement with one another.

2. The cassette set forth in claim 1 wherein the tilt of at least one of the narrow walls is about 0.5% of the total cast width.

3. The cassette set forth in claim 1 wherein the tilt of at least one of the narrow walls is continuous from about the wider end of the plate to the narrow end.

4. The cassette set forth in claim 1 wherein at least one of the walls is comprised of an alloy containing beryllium and copper.

5. The cassette set forth in claim 1 wherein at least one of the walls comprises an alloy containing copper, chrome and zirconium.

6. The cassette set forth in claim 1 wherein at least one of the walls comprises a refractory material.

7. The cassette set forth in claim 1 wherein at least one of the walls is comprised of a copper alloy.

8. A method of continuously casting relatively thin slabs, which comprises the steps of:

pouring molten material into a trough, the trough including a pair of vertically disposed, opposed broad walls and a pair of opposed narrow walls, the trough further having an entry end for receiving molten material and an exit end for dispensing the material, the narrow walls being generally wider at the entry end than the exit end and being adapted for sealing engagement with the broad walls so as to prevent leakage of the material therebetween;

adjusting during casting at least one of the narrow walls to a selected tilt for changing the width of the slab, back edges of at least one of the adjustable narrow walls being relieved in a region corresponding generally to the transition zone of the trough for positioning the narrow wall in a generally less than vertical plane during casting while maintaining the broad and narrow walls in sealing engagement with one another wherein the narrow walls having a selected chamfered-like region, and having a concave portion gradually increasing in depth from about the wider end to the narrower end;

adjusting the spacing between the narrow walls while retaining the broad and narrow walls in sealing engagement with one another; and dispensing at least a semi-solidified slab of the material from the exit end of the trough.

9. The method set forth in claim 8 wherein the tilt of at least one of the narrow face walls is about 0.5% of the total cast width.

10. The cassette set forth in claim 8 wherein the tilt of at least one of the narrow walls is continuous from about the wider end of the plate to the narrow end.

11. The method set forth in claim 8 wherein at least one of the walls is comprised of an alloy containing beryllium and copper.

12. The method set forth in claim 8 wherein at least one of the walls is comprised of an alloy containing copper, chrome and zirconium.

13. The method set forth in claim 8 wherein at least one of the walls is comprised of a refractory material.

14. The method set forth in claim 8 wherein at least one of the walls is comprised of a copper alloy.

15. A method of continuously casting relatively thin slabs, which comprises the steps of:

pouring molten material into a trough, the trough including a pair of vertically disposed, opposed broad walls and a pair of opposed narrow walls, the trough further having an entry end for receiving molten material and an exit end for dispensing the material, the narrow walls being generally wider at the entry end than the exit end and being adapted for sealing engagement with the broad walls so as to prevent leakage of the material therebetween;

adjusting during casting at least one of the narrow walls to a selected slab width, back edges of at least one of the adjustable narrow walls being relieved in proximity to the transition zone of the trough for positioning the narrow wall in a generally less than vertical plane during casting while maintaining the broad and narrow walls in sealing engagement with one another, at least one of the narrow walls comprising a face plate with horizontally disposed, concave portions continuously from about the wider end to the narrower end of the plate, to accommodate deformation of solidified portions of the material without undue stress and cracking wherein the narrow walls having a selected chamfered-like region, and having a concave portion gradually increasing in depth from about the wider end to the narrower end;

adjusting the spacing between the narrow walls while retaining the broad and narrow walls in sealing engagement with one another; and dispensing at least a semi-solidified slab of the material from the exit end of the trough.

16. A cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for scaling engagement with the broad walls so as to prevent leakage of the material therebetween;

at least one of the narrow walls being oriented at a selected tilt and adjustable at the tilt for changing the width of the slab during casting, back edges of at lest one of the adjustable narrow walls having a selected chamfered-like portion in a region corresponding generally to the transition zone of the trough to allow positioning of the narrow wall in a generally less than vertical plane during casting while maintaining the narrow and broad walls in sealing engagement with one another;

at least one of the narrow walls comprising a face plate and a back-up plate, the face plate having cooling slots therein, the slots being deeper in the lower section of the narrow face plate than in the upper section;

at least one of the narrow walls further comprising a face plate with horizontally disposed, concave positions continuously from about the wider end to the narrower end of the plate, the concave portions gradually increasing in depth from about the wider end to the narrower end, to accommodate deformation of solidified portions of the material without undue stress and cracking; and a multi-directional drive assembly for adjusting the spacing between the narrow walls and for maintaining the tilt of at least one of the narrow walls while retaining the broad and narrow walls in sealing engagement with one another;

a multi-directional drive assembly for adjusting the spacing between the narrow walls and for maintaining the tilt of at least one of the narrow walls while retaining the broad and narrow walls in sealing engagement with one another.

17. A cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls being oriented at a selected tilt and adjustable at the tilt for changing the width of the slab during casting, back edges of at lest one of the adjustable narrow walls having a selected chamfered-like portion in a region corresponding generally to the transition zone of the trough to allow positioning of the narrow wall in a generally less than vertical plane during casting while maintaining the narrow and broad walls in sealing engagement with one another;

at least one of the narrow walls comprising a face plate and a back-up plate, the face plate having cooling slots therein, the slots being deeper in the lower section of the narrow face plate than in the upper section;

at least one of the narrow walls further comprising a face plate with horizontally disposed, concave portions continuously from about the wider end to the narrower end of the plate, the concave portions gradually increasing in depth front about the wider end to the narrower end, to accommodate deformation of solidified portions of the material without undue stress and cracking; and a multi-directional drive assembly for adjusting the spacing between the narrow walls and for maintaining the tilt of at least one of the narrow walls while retaining the broad and narrow walls in sealing engagement with one another.

18. The cassette set forth in claim 17 wherein the concave portions are in proximity to the transition region such that the slab perimeter of the shell formed in the meniscus region of the slab edge is less than or equal to that exiting the mold.

19. A cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls being oriented at a selected lilt and adjustable at the tilt for changing the width of the slab during casting, back edges of at lest one of the adjustable narrow walls having a selected chamfered-like portion in a region corresponding generally to the transition zone of the trough to allow positioning of the narrow wall in a generally less than vertical plane during casting while maintaining the narrow and broad walls in sealing engagement with one another;

at least one of the narrow walls further comprising a face plate with horizontally disposed, concave portions continuously from about the wider end to the narrower end of the plate, the concave portions gradually increasing in depth from about the wider end to the narrower end, to accommodate deformation of solidified portions of the material without undue stress and cracking, the face plate comprising a beryllium-copper alloy; and a multi-directional drive assembly for adjusting the spacing between the narrow walls and for maintaining the tilt of at least one of the narrow walls while retaining the broad and narrow walls in sealing engagement with one another.

20. A cassette for a continuous casting mold, the cassette comprising:

a trough including a pair of vertically disposed, opposed broad walls and a pair of opposed narrow walls, the trough having an entry end for receiving molten material and an exit end for dispensing the material, the narrow walls being generally wider at the entry end than the exit end and being adapted for sealing engagement with the broad walls so as to prevent leakage of the material therebetween;

at least one of the narrow walls having back edges with a selected chamfered-like portion in a region corresponding generally to the transition zone of the trough to allow positioning of the narrow wall in a generally less than vertical plane during casting while maintaining the narrow and broad walls in sealing engagement with one another;

at least one of the narrow walls further comprising a face plate with horizontally disposed, concave portions continuously from about the wider end to the narrower end of the plate, the concave portions gradually increasing in depth from about the wider end to the narrower end, to accommodate deformation of solidified portions of the material without undue stress and cracking; and a multi-directional drive assembly for adjusting the spacing between the narrow walls and for maintaining the tilt of at least one of the narrow walls while retaining the broad and narrow walls in sealing engagement with one another.

21. A narrow wall for a cassette of a continuous casting mold, wherein the wall has a beryllium-copper face plate with continuous, horizontally disposed, concave portions for accommodating deformation of solidified portions of the material being cast without undue stress and cracking, and edges having a selected chamfered-like portion in a region corresponding generally to the transition zone of the mold for positioning of the narrow wall in a generally less than vertical plane while maintaining the narrow wall in sealing engagement with adjacent walls of the cassette wherein the concave portions gradually increasing in depth from about the wider end to the narrower end.

* * * * *